United States Patent [19]

Tokieda

[11] Patent Number: 4,514,791

[45] Date of Patent: Apr. 30, 1985

[54] LAMP RIBBON

[76] Inventor: Naomitsu Tokieda, 26-12, Shimomeguro 5-chome, Meguro-ku, Tokyo, Japan

[21] Appl. No.: 531,023

[22] Filed: Sep. 12, 1983

[51] Int. Cl.[3] ..... F21V 21/00

[52] U.S. Cl. ..... 362/249; 362/391; 362/448

[58] Field of Search ..... 362/249, 391, 448

[56] References Cited

U.S. PATENT DOCUMENTS 3,500,036 3/1970 Szentveri ..... 362/249

3,740,546 6/1973 Boysen ..... 362/249

*Primary Examiner*—Donald P. Walsh

*Attorney, Agent, or Firm*—Michael D. McCully

[57] ABSTRACT

A lamp ribbon is made of a number of lamp units fixed to a belt construction. The belt construction is made of an upper belt layer and a lower belt layer, each generally formed as a strip and made of a flexible electrically insulating material, which are laid against and fixed to one another, and also includes two strip shaped conductors which are laid between the upper and lower belt layers in parallel and are sandwiched therebetween. Parts of the lower belt layer at a number of places are absent, so as to expose the two conductors for a certain distance at each of these places, and at each such place a pair of apertures are formed through the upper belt layer between the two conductors. Each of the lamp units includes a bulb socket abutted against a part of the outer surface of the upper belt layer opposed to one of the places where the lower belt layer is absent. The bulb socket has a pair of terminals which protrude from it, and each of these terminals passes through one of the corresponding pair of apertures in the upper belt layer and then is bent over and soldered to one of the conductors. A bulb is detachably mounted to the bulb socket, and has a pair of terminals each of which is electrically connected to one of the terminals of the bulb socket.

5 Claims, 12 Drawing Figures

LAMP RIBBON

BACKGROUND OF THE INVENTION

The present invention relates to a lamp ribbon, i.e. to a flexible belt shaped cable construction bearing a series of bulbs which are energized by electricity passing through electrical conductors incorporated in said belt construction so as to be illuminated. Such a lamp ribbon is typically used for decorative purposes, such as for instance for decorating a place of business or a showcase therein, or for embellishing a display in a shop window, and can be either extended straight or wound or draped or festooned in any of a variety of configurations about or from various objects, presenting when energized an attractive appearance of a sequence of glowing points of light.

In FIGS. 1 and 2 of the accompanying drawings there is shown the construction of a conventional such lamp ribbon: FIG. 1 is a perspective drawing showing the belt construction and one of the plurality of lamps mounted thereon, and FIG. 2 shows a cross section of said one of the plurality of lamps and its mounting arrangements, and is taken in a plane shown by the arrows II—II in FIG. 1. The details of this conventional construction will now be explained.

As seen in FIG. 1, the belt construction denoted by the reference numeral 1 comprises an upper belt layer 2 (from the point of view of the figure; in this specification, spatially referent terms should henceforward always be understood as being with reference to the relevant figure, and the "front" or "upper" surface of the lamp ribbon is considered as being that one on which the lamps are mounted, while the "rear" or "lower" surface is considered as being the opposite surface to said front surface) and a lower belt layer 3, both of which are formed from an electrically insulating material which is flexible, such as for instance from a synthetic resin. The upper belt layer 2 and the lower belt layer 3 are sandwiched together on either side of two electrical conductors 4 and 5, which extend in parallel side by side, and which themselves are formed as thin ribbons which are also flexible, being made for example of metal. An incandescent type electric bulb 6 is mounted on the belt construction 1, being supported in a mounting tube 7, and has two terminal wires 8 and 9.

In more detail, as best seen in FIG. 2, the mounting of the electric bulb 6 to the belt construction 1 has in such prior art construction been performed as follows. A short part of the upper belt layer 2 above the two conductors 4 and 5 has been removed, the mounting tube 7 has been fixed to the upper surface of the upper belt layer 2 so as to surround the thus exposed portions of the conductors 4 and 5 by plastic welding under pressure or the like, the two wire terminals 8 and 9 of the electric bulb 6 have been led downwards from the body of said bulb 6 until they meet respectively the conductors 4 and 5, and, by poking the free ends of said two wire terminals 8 and 9 into the belt construction 1 along the upper surfaces of said respective conductors 4 and 5 for a certain distance in the longitudinal direction, these end portions of said two wire terminals 8 and 9 have been made to lie along and in contact with the respective conductors 4 and 5, being squeezed thereagainst by the material of the upper belt layer 2. The reference numeral 45 denotes a layer of adhesive material for securing the lamp ribbon to an object to be decorated, such as for example the edge of a showcase or a wall or ceiling of a shop.

This construction is relatively cheap to produce, but has deficiencies as follows.

First, since the electric bulb 6 is not removable from the belt construction 1, if the electric bulb 6 becomes burnt out or otherwise fails over a period of use, it is impossible to change the electric bulb 6 by itself, and accordingly if the lamp ribbon as a whole is left in service an unsightly gap appears in the sequence of glowing points of light presented thereby, which deteriorates the appearance thereof. On the other hand, changing the entire lamp ribbon because just one of the bulbs thereon has failed is obviously uneconomic, especially if the length of the portion of lamp ribbon used in one piece is quite long.

Next, since in the above described prior art construction the mounting tube 7 which supports the electric bulb 6 is welded by plastic welding to the front surface of the belt construction 1, when this is done the part of said front surface of the belt construction 1 surrounding the base of the mounting tube 7 also becomes melted, which not only is unsightly and deteriorates the appearance of the finished lamp ribbon, but also can cause some permanent or fixed bending of the upper belt layer 2, which can in its turn cause permanent bends to be formed in the finished lamp ribbon, which will mean that its free drapability is affected. In such a case, the appearance of a finished display including the lamp ribbon as an ornament may become rather peculiar, because the lamp ribbon does not flex freely and does not hang straight by the action of gravity, as should be desirable. In short, from this point of view, it is desirable that the flexibility of the finished lamp ribbon product should be uniform throughout, or at least that, where portions of said lamp ribbon are inevitably stiffened due to the presence of the lamp units mounted thereon, these portions of the lamp ribbon should be stiffened straight so as to form straight sections.

Next, in the case that the material of the upper belt layer is transparent, which is typically the case in order to present an interesting appearance, the end portions of the two wire terminals 8 and 9 lying along and in contact with the respective conductors 4 and 5 on the front sides thereof are visible from the front of the lamp ribbon (i.e. from the upper side thereof in FIG. 1), which again is unsightly and deteriorates the appearance of the finished lamp ribbon.

Next, since part of the front or upper belt layer 2 is required to be removed in order to poke the free ends of the two wire terminals 8 and 9 into the belt construction 1 along the upper surfaces of the conductors 4 and 5, this causes a deficiency in electrical insulating characteristics on the front side of the finished lamp ribbon, and thereby a risk is caused of electric shock during use, or of an electrical accident which might for example lead to fire.

Further, because the two wire terminals 8 and 9 are inserted into the belt construction 1 and lie along and against the upper surfaces of said respective conductors 4 and 5 for a certain distance in the longitudinal direction, but are not positively secured or contacted electrically to said conductors 4 and 5, being instead just squeezed thereagainst by the material of the upper belt layer 2, thereby there remains a possibility that poor contact between one of these wire terminals and its conductor may cause one of the bulbs 6 not to be lit when the lamp ribbon is supplied with electrical energy.

This will again cause an unsightly gap to appear in the sequence of glowing points of light presented by the lamp ribbon and will deteriorate the appearance thereof.

Yet further, this inserting of the wire terminals into the belt construction 1 along the longitudinal direction thereof is difficult to perform automatically, and as a result this prior art lamp ribbon is expensive to manufacture.

Finally, there is a slight risk that, during the process of poking the free ends of the two wire terminals 8 and 9 into the belt construction 1 along the upper surfaces of the conductors 4 and 5, the scraping of one of the wire terminals along its conductor may break said conductor, which is catastrophic for the performance of the lamp ribbon as a whole, since typically such a lamp ribbon is used by an electrical voltage being applied between one pair of ends only of the conductors 4 and 5. Thus, if one of the conductors should become broken in such a fashion, all the bulbs on the other side of the break point from the electrical source will fail to light, which will render the lamp ribbon as a whole quite unserviceable. Since the conductors 4 and 5 in general are stronger than the wire terminals 8 and 9, the risk of such an occurrence is small; but it is present.

To date no construction for a lamp ribbon has been conceived of that satisfactorily avoids the above mentioned problems.

SUMMARY OF THE INVENTION

Accordingly, it is the primary object of the present invention to provide a lamp ribbon which avoids the aforementioned problems.

It is a further object of the present invention to provide a lamp ribbon, during the use of which any one of the bulbs incorporated thereon can be replaced individually.

It is a further object of the present invention to provide a lamp ribbon which does not present any unsightly appearance.

It is a further object of the present invention to provide a lamp ribbon which can hang freely.

It is a further object of the present invention to provide a lamp ribbon which does not have any permanent bends formed therein.

It is a further object of the present invention to provide a lamp ribbon, of which any stiffened portions are substantially straight portions.

It is a further object of the present invention to provide a lamp ribbon, in which wire connections are not visible from the front side thereof which presents the lamps incorporated therein.

It is a further object of the present invention to provide a lamp ribbon which presents as low a risk of electrical shock, electrical accident, and fire as possible.

It is a yet further object of the present invention to provide a lamp ribbon which does not suffer from any defect of possible poor contact for the terminals of the lamps incorporated thereon.

It is a yet further object of the present invention to provide a lamp ribbon, the manufacture of which does not entail any risk of damage which might deteriorate the function of the ribbon as a whole.

It is a yet further object of the present invention to provide a lamp ribbon which is economical during use.

It is a yet further object of the present invention to provide a lamp ribbon which is long lasting and durable during use.

It is a yet further object of the present invention to provide a lamp ribbon which is easy to manufacture.

It is a yet further object of the present invention to provide a lamp ribbon which can easily be manufactured automatically.

It is a yet further object of the present invention to provide a lamp ribbon which is cheap.

According to the most general aspect of the present invention, these and other objects are accomplished by a lamp ribbon, comprising: (a) a belt construction, comprising: (a1) an upper belt layer and a lower belt layer, each generally formed as a strip and made of a flexible electrically insulating material, said upper and lower belt layers being laid against one another, aligned together, and fixed to one another; and (a2) two conductors, each formed as a strip and made of an electrically conducting material, which are laid between said upper belt layer and said lower belt layer parallel to one another and separated by a certain distance, and which are held by being sandwiched between said upper belt layer and said lower belt layer; (a3) parts of said lower belt layer at a plurality of places thereon being absent, so as to expose said two conductors for a certain longitudinal distance at each of said plurality of places, at each such place a pair of apertures being formed through said upper belt layer between said two conductors so as to open to said place; and (b) a plurality of lamp units, each comprising: (b1) a bulb socket which is abutted against a part of the outer surface of said upper belt layer opposed to a one of said plurality of places where said lower belt layer is absent; (b2) a pair of terminals which protrude from said bulb socket, each of said terminals passing through one of the pair of apertures formed in said upper belt layer opening to said one of said plurality of places and then being bent over and being soldered to one of said conductors; and (b3) a bulb comprising a pair of terminals, detachably mounted to said bulb socket, each one of said pair of terminals of said bulb being thus electrically connected to one of said terminals of said bulb socket.

According to such a construction, if during use one of the bulbs fails, then it is easy for the operator to substitute a new bulb therefor, without any necessity occurring of throwing away the entire lamp ribbon, because the bulbs are detachably mounted in the bulb sockets. Accordingly it is not required to tolerate an unsightly gap in the sequence of spots of light produced by the lamp ribbon, nor is it required to change the entire lamp ribbon length, which would be expensive and troublesome. Further, since the bulb sockets which support the electric bulbs need not be welded to the belt construction, but are satisfactorily pulled thereagainst by the tension of the terminals, no risk arises of any part of the belt construction surrounding the bases of the lamp units becoming melted, and accordingly unsightliness and deterioration of the appearance of the finished lamp ribbon are avoided, and also permanent bending of the lamp ribbon is avoided, thus ensuring its free drapability and ensuring that the stiffened portions of the lamp ribbon in the regions of the lamp units are not bent but are relatively straight sections.

Further, if the material of the upper and perhaps the lower belt layers is transparent as is typically the case, then according to the present invention no unsightly connections are visible from the front of the lamp ribbon, since the places where the terminals of the lamp units are soldered to the conductors are concealed behind the lamp units. Also, since no part of the front or upper belt layer covering the conductors is required to be removed, no deficiency in electrical insulating characteristics on the front side of the finished lamp ribbon is caused thereby, thus diminishing the risk of electric shock or electrical accident during use. Further, because the two wire terminals of each lamp unit are directly and positively soldered and thus contacted electrically to the conductors, thereby the possibility of poor contact between one of these wire terminals and its conductor is virtually eliminated. This soldering is easy to perform automatically, and as a result this lamp ribbon accordig to the present invention is cheap to manufacture. There is also no substantial risk of breaking either of the conductors during manufacture of the lamp ribbon.

Further, according to a more particular aspect of the present invention, these and other objects are more particularly and concretely accomplished by a lamp ribbon as described above, further comprising a plurality of pieces of insulating material, each being fixed over the exposed parts of said conductors and the exposed parts of said terminals at one of said places and covering them so as to insulate them from the outside.

According to such a construction, the side of the lamp ribbon opposite to that to which the lamp units are fixed is also well and positively insulated.

Further, according to another more particular aspect of the present invention, these and other objects are more particularly and concretely accomplished by a lamp ribbon as first described above, wherein further the exposed surface of said lower belt layer is provided with an adhesive material thereon.

According to such a construction, the lamp ribbon can be conveniently stuck to a fixed object, so as to aid in its use for decoration.

Further, according to a yet more particular aspect of the present invention, these and other objects are more particularly and concretely accomplished by a lamp ribbon as first described above, wherein said conductors are made of copper and are plated with tin.

According to such a construction, the soldering of the terminals of the lamp units to the conductors is made easier, and this is very important, since if this soldering were difficult a risk might exist of heating up and damaging the material of the upper and lower belt portions, which typically is a synthetic resin.

Further, according to a yet more particular aspect of the present invention, these and other objects are more particularly and concretely accomplished by a lamp ribbon as first described above, wherein further each lamp unit comprises a bulb base into which said bulb is detachably fitted with said terminals of said bulb being bent so as to hold said bulb to said bulb base, said bulb base being slidably fittable into said bulb socket so as to contact said terminals of said bulb against said terminals of said bulb socket.

According to such a construction, a particularly cheap form of bulb may be employed, consisting essentially only of a glass bulb with two terminals protruding therefrom, and, since the bulb base is reusable with a new replacement bulb and is not permanently attached to the bulb, the advantage of economy is available.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENT

Figure 1:
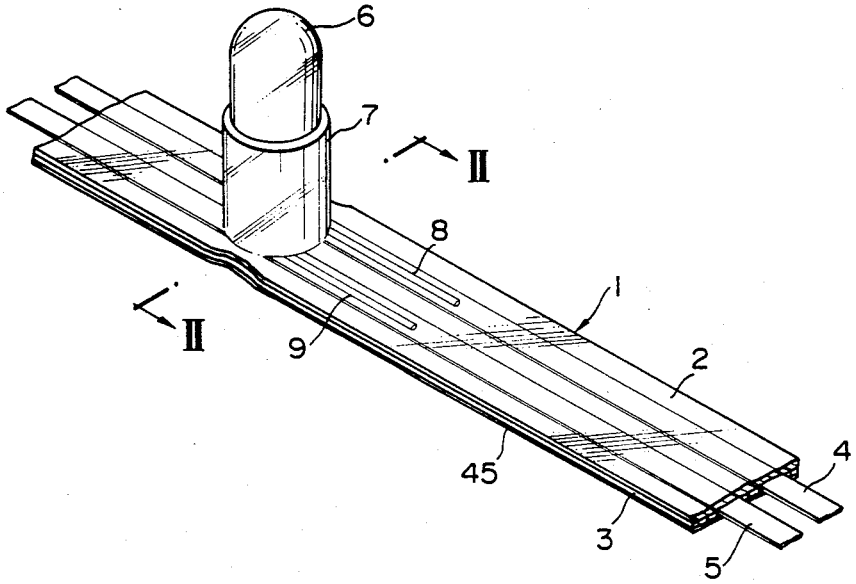
FIG. 1 PRIOR ART
FIG. 1 relates to a prior art lamp ribbon, and is a perspective view showing a belt construction of said prior art lamp ribbon and one of a plurality of lamps mounted thereon.

The present invention will now be described with reference to the preferred embodiment thereof, and with reference to the appended drawings. FIGS. 3 through 12 show various parts of this preferred embodiment in various ways; the same parts are denoted in the various ones of these figures by the same reference numerals.

Figure 3:
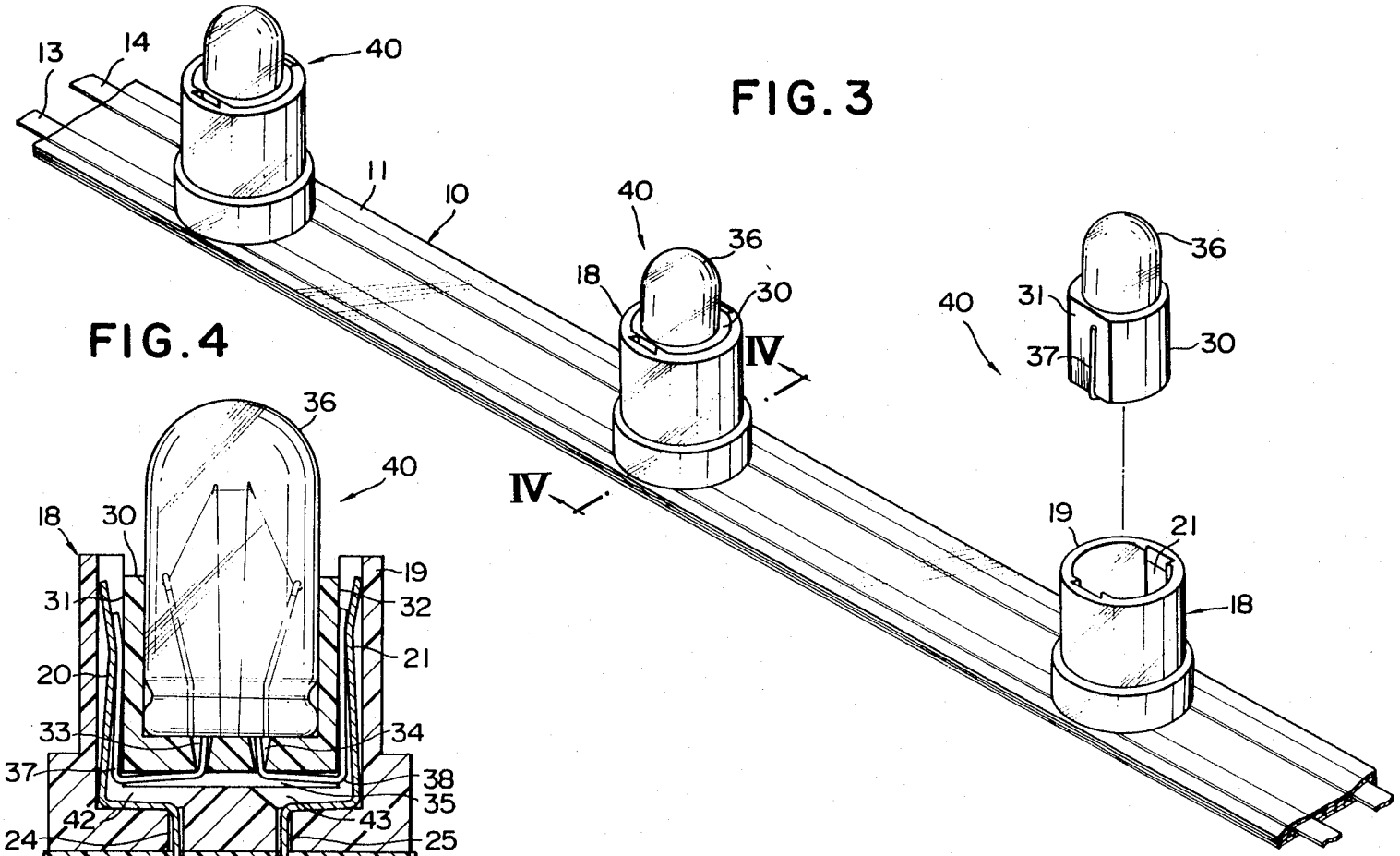
FIG. 3 is a general perspective view of the preferred embodiment of the lamp ribbon of the present invention, showing a belt construction incorporated therein and a plurality of lamp units mounted to said belt construction, and further showing the electric bulb of one of said lamp units and its associated base in a position as removed from a bulb socket of said lamp unit.

In FIG. 3 there is shown a general perspective view of this preferred embodiment of the lamp ribbon of the present invention, with one of the electric bulbs incorporated therein and its associated base shown as exploded by the single dotted line in a position removed from a bulb socket thereof. This lamp ribbon comprises a flexible belt construction, designated by the reference numeral 10, and a plurality of lamp units 40 mounted therealong at approximately equal intervals. As will be seen later, an incandescent type electric bulb 36 is incorporated in each of these lamp units 40, and these electric bulbs 36 are, when the lamp ribbon is being used, illuminated by being supplied with electrical energy via conductors 13 and 14 incorporated in the belt construction 10, being connected to said conductors in parallel.

Figure 5:
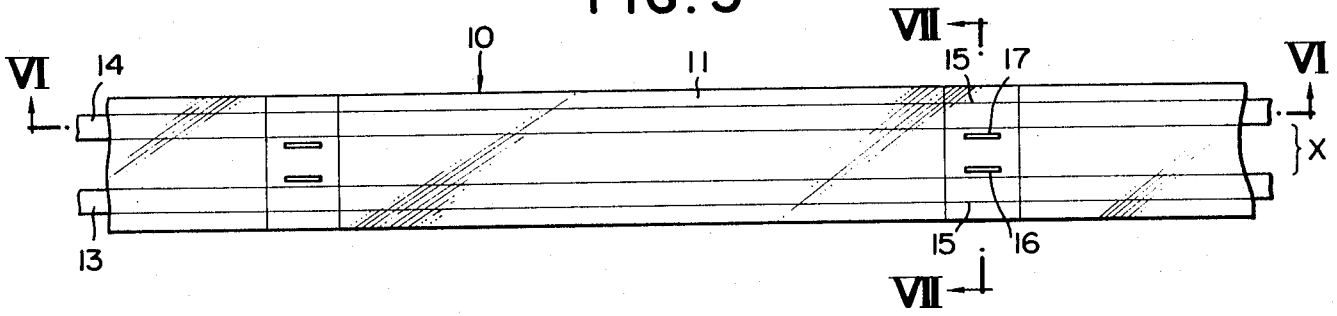
FIG. 5 is a plan view of said belt construction by itself, with the lamp units not yet fitted thereto.
Figure 6:
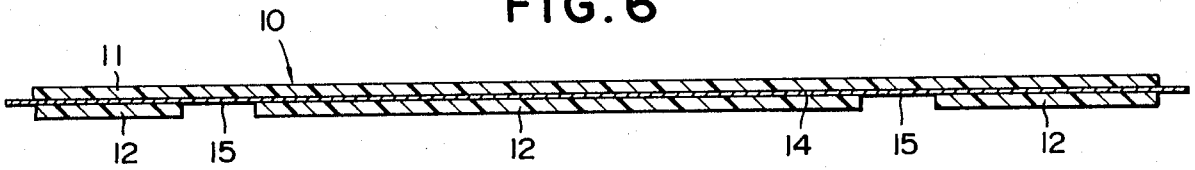
FIG. 6 is a longitudinal sectional view of said belt construction, taken along a plane indicated by the arrows VI—VI in FIG. 5.
Figure 7:
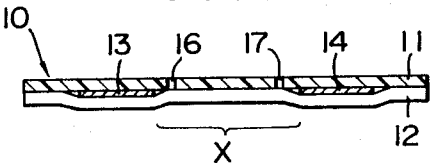
FIG. 7 is a transverse sectional view of said belt construction taken along a plane indicated by the arrows VII—VII in FIG. 5.

First, the details of the flexible belt construction 10 will be explained. FIG. 5 shows the belt construction 10 by itself in plan view; FIG. 6 is a longitudinal sectional view thereof taken along a plane indicated by the arrows VI—VI in FIG. 5; and FIG. 7 is a transverse sectional view of said belt construction taken along a plane indicated by the arrows VII—VII in FIG. 5. The belt construction 10 is formed from a front side or upper belt layer 11 and a rear side or lower belt layer 12, which are made of a flexible and soft material which is electrically insulating, such as a synthetic resin. These belt layers 11 and 12 are laid together and secured together with a pair of ribbon conductors or wires 13 and 14 being sandwiched between them. Each of the ribbon conductors 13 and 14 is shaped as a flattened strip of metal, and is flexible, at least in a plane perpendicular to its surface and containing its longitudinal axis; in this preferred embodiment, these conductors 13 and 14 are made of copper, plated with tin, in order to facilitate assembly, as will be explained later. The ribbon conductors 13 and 14 are laid side by side between the upper and lower belt layers 11 and 12 parallel to one another with a certain interval or gap of magnitude "x" being left therebetween.

The lower belt layer 12 is however discontinuous, being missing for a certain longitudinal distance at regularly spaced places 15 on the lower side of the belt construction 10 which correspond to the places on the upper belt layer 11 thereof where it is intended to mount the lamp units 40, so as to leave exposed portions of the ribbon conductors 13 and 14 at these places 15. (In this connection, although the edge of the lower belt layer 12 can be seen in FIG. 7, it does not lie in the plane of the figure, but behind it). In between the conductors 13 and 14 at these places 15, i.e. in the gap of width "x" therebetween, there are provided apertures 16 and 17 in the upper belt layer 11 for passage of lamp unit terminals 20 and 21 as will be explained later; these apertures 16 and 17 are not required to be large, and in fact in the shown preferred embodiment they are simple slits extending in the longitudinal direction of the belt construction 10.

Next, the details of the lamp units 40 will be explained. One of them is shown in detailed cross section in FIG. 4, which is taken along a plane indicated by the arrows IV—IV in FIG. 3. This lamp unit 40 comprises an electric bulb 36, a bulb base 30 into which said electric bulb 36 is fitted, and a bulb socket 18 into which the bulb base 30 with the bulb 36 therein is fitted.

Figure 8:
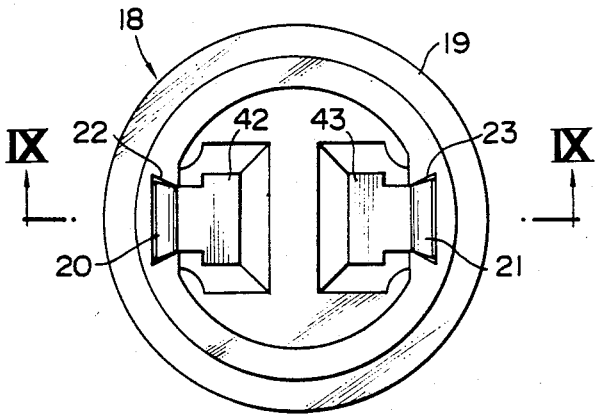
FIG. 8 is a plan view of a bulb socket incorporated in said lamp unit, shown by itself.
Figure 9:
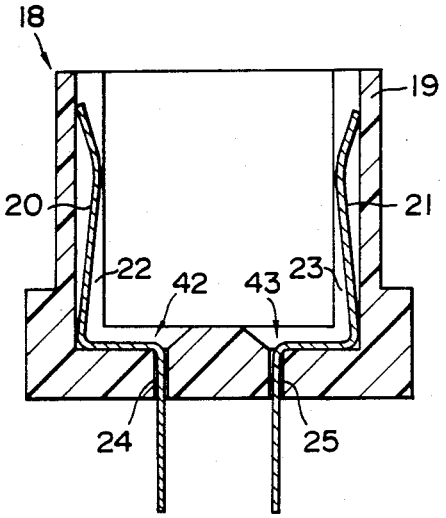
FIG. 9 is a longitudinal sectional view of said bulb socket, taken in a plane indicated by the arrows IX—IX in FIG. 8.

The bulb socket 18 is shown by itself in plan view in FIG. 8, and in longitudinal cross section in FIG. 9. The bulb socket 18 has a main body 19 which may be made of injection molded synthetic resin, for example, and a pair of electrically conducting terminals 20 and 21, formed typically of metal. The main body 19 is formed as a hollow tube open at its upper end and closed at its lower end, with a flanged base; and two slots 24 and 25 are formed in said closed lower end thereof, 180° apart, through which the lower portions of the terminals 20 and 21 are passed so that they project downwards for a certain distance outside the lamp socket 18. The upper portions of the terminals 20 and 21 inside the lamp socket 18 are bent so that they extend outwards from the axis thereof in cutaways 42 and 43 formed on the inner surface of its closed end, and then are bent again so that they extend generally along the cylindrical inner surface of the tubular portion of the lamp socket 18 in its longitudinal direction, in fact lying in two grooves 22 and 24 formed, 180° apart, in said cylindrical inner surface. These portions of the terminals 20 and 21 are somewhat bent, as may be seen in FIGS. 4 and 9, so that their convex sides face the axis of the lamp socket 18, to provide good electrical contact with the bulb 36 as will become apparent later.

Figure 2:
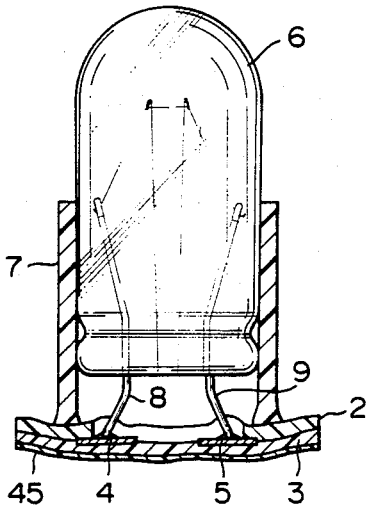
FIG. 2 PRIOR ART
FIG. 2 also relates to said prior art lamp ribbon, and shows a cross section of said one of the plurality of lamps and its mounting arrangements, being taken in a plane shown by the arrows II—II in FIG. 1.
Figure 10:
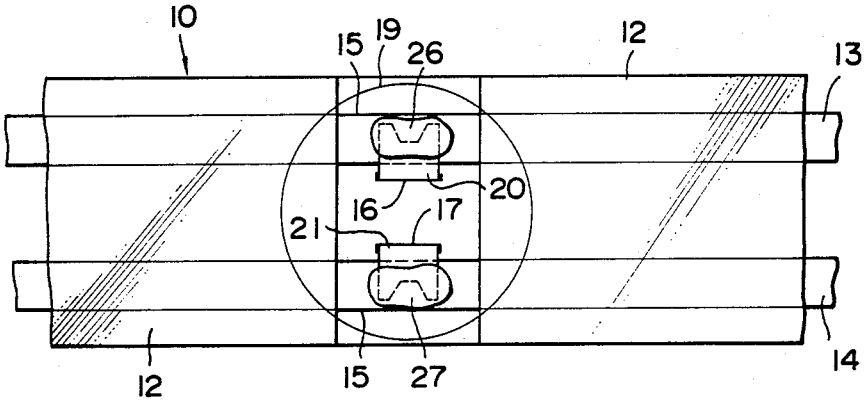
FIG. 10 is a plan view from underneath, showing the surface of the belt construction on the side remote from the lamp units, and particularly showing how said lamp units are secured to said belt construction by soldering of their terminals.

The way in which the lamp units 40 are secured to the belt construction 10 will now be explained, particularly referring to the one of these lamp units shown in FIG. 4. During assembly, the lamp socket 18 is offered to a place on the front or upper side of the belt construction 10 opposite to one of the places 15 described above where the lower belt layer 12 thereof is removed, and its downwardly projecting lower ends (as seen in FIG. 9) of the terminals 20 and 21 are inserted through the slit apertures 16 and 17, so as to project out on the side of the exposed portions of the ribbon conductors 13 and 14. Then these lower ends of the terminals 20 and 21 are bent outwards (this may easily be performed automatically), so as to be pressed against the exposed portions of the conductors 13 and 14, respectively. Next, these end portions of the terminals 20 and 21 are soldered to the conductors 13 and 14, for example by an automatic soldering machine; this is much facilitated in the shown preferred embodiment by the fact that the material of which the conductors 13 and 14 is made is copper plated with tin, and this is most important in view of the importance of minimizing damage to the belt construction 10 caused by the hot solder. These soldered portions are denoted by the reference numerals 26 and 27. In contrast to the case in the prior art discussed above with reference to FIGS. 1 and 2, the body 19 of the lamp socket 18 is not welded to the upper surface of the upper belt layer 11, but is contacted thereto and held securely against by tension present in the terminals 20 and 21 thereof. FIG. 10 shows from the underneath the place 15 on the lower surface of the belt construction 10, with the terminals 20 and 21 soldered to the conductors 13 and 14. Finally, over the places 15 on the back of the thus formed lamp ribbon where the soldered places 26 and 27 are thus present and exposed, spots 28 of electrically insulating material such as synthetic resin are deposited in liquid form and then allowed to harden, so as to ensure electrical insulation and also smoothness; and subsequently a layer of adhesive material 29 may be laid upon the back of the lamp ribbon, although this is not essential but is dependent upon the particular application envisaged therefor.

Figure 11:
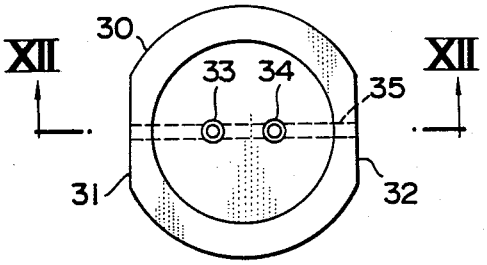
FIG. 11 is a plan view of a bulb base incorporated in said lamp unit.
Figure 12:
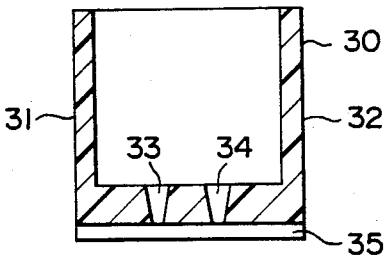
FIG. 12 is a longitudinal sectional view of said bulb base, taken in a plane shown by the arrows XII—XII in FIG. 11.

The bulb base 30 is particularly shown in FIGS. 11 and 12; FIG. 11 is a plan view thereof, and FIG. 12 is a longitudinal sectional view, taken in a plane shown by the arrows XII—XII in FIG. 11. The bulb base 30 may be made of injection molded synthetic resin, for example, and is formed as a hollow cylinder with one end open and one end closed, and two apertures 33 and 34 are formed in said closed lower end thereof, 180° apart. A groove 35 extending along a diameter of the outside of the closed end of the bulb base 30 leads from these two apertures 33 and 34 to the ends of two flattened portions 31 and 32 formed on the outside of the cylindrical portion of the bulb base 30, 180° apart, extending along generators thereof.

Figure 4:
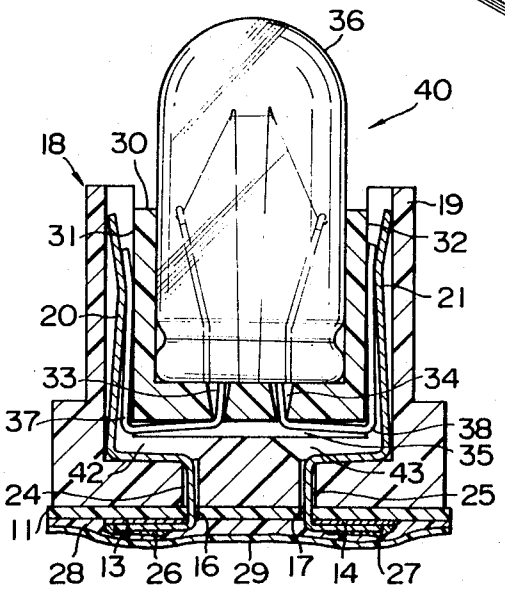
FIG. 4 is a detailed cross sectional view of one of said plurality of lamp units, and is taken along a plane indicated by the arrows IV—IV in FIG. 3.

The electric bulb 36, as can be seen in FIG. 4, is of a very simple type, having no base but just consisting of a glass bulb with a filament etc. inside and with two wire terminals 37 and 38 protruding therefrom. When the bulb 36 is to be fitted to the light unit 40, then the bulb base 30 is removed therefrom, and the two wire terminals 37 and 38 of the bulb 36 are pulled through the apertures 33 and 34, so that the bulb 36 comes to be partly received in the inner cavity of the bulb base 30 with a portion thereof protruding. Then, the two wire terminals 37 and 38 are bent outwards and around the outer surface of the bulb base 30, lying in the groove 35 and then respectively against the flattened portions 31 and 32, so as to lie in the configuration as shown with respect to the detached bulb and bulb base shown on the right hand side of FIG. 3. Finally, the lamp unit 40 is assembled by the electric bulb 36 and its fitted base 30 being approached towards and pushed into the cavity within the body 19 of the bulb socket 18, so that as seen in FIG. 4 the terminals 20 and 21 of the socket 18 are pressed by their curvature and their elasticity against the wire terminals 37 and 38 of the bulb 36, thus making good electrical contact thereagainst and also holding the bulb 36 and the base 30 securely in the socket 18. However, as will be readily understood, an operator can if necessary easily pull the bulb 36 and the base 30 associated therewith out from the socket 18 and change the bulb 36 for a new one.

In use of this lamp ribbon, a desired length may be easily cut off and either fixed in a straight or other configuration or wound or festooned or draped in a desired position and orientation for providing decoration. At this time, the adhesive 29 may be used for securing all or part of this lamp ribbon length to a showcase, a wall, a ceiling, or some other surface. Then an electric source is connected so as to supply a voltage appropriate for the operation of the bulbs 36 between the two conductors 13 and 14, and this will illuminate all the bulbs 36 in parallel, via the terminals 20 and 21 of their respective bulb sockets 18 and via their own terminal wires 37 and 38. If, during use in this way, one of the bulbs 36 fails, then as explained above it is easy for the operator to substitute a new bulb therefor, without any necessity occurring of throwing away the entire lamp ribbon length. Accordingly it is not required to tolerate an unsightly gap in the sequence of spots of light produced by the lamp ribbon, nor is it required to change the entire lamp ribbon length, which would involve expense and also perhaps much trouble for rearranging a new lamp ribbon length. Therefore the present invention provides the advantages of economy and convenience during use.

Next, since in the case of the present invention the sockets 18 which support the electric bulbs 36 are not welded to the belt construction 1, but are only pulled thereagainst by the tension of the terminals 20 and 21 as explained above, thus no risk arises of any part of the belt construction 1 surrounding the bases of the lamp units 40 becoming melted, which accordingly avoids any unsightliness and deterioration of the appearance of the finished lamp ribbon, and also avoids any permanent bending of the lamp ribbon, thus ensuring its free drapability, and ensuring that the stiffened portions of the lamp ribbon (in the regions of the lamp units 40) are not bent, but are relatively straight sections.

Further, if the material of the upper and perhaps the lower belt layers 11 and 12 is transparent, which is typically the case for decorative purposes, then according to the shown construction no unsightly connections are visible from the front of the lamp ribbon, since the places where the terminals 20 and 21 of the lamp units 40 are soldered to the conductors 13 and 14 are concealed behind the lamp units. This is a substantial improvement over the case with the described prior art.

Next, since no part of the front or upper belt layer 11 covering either of the conductors 4 and 5 is required to be removed, as opposed to the prior art no deficiency in electrical insulating characteristics on the front side of the finished lamp ribbon is caused thereby, thus diminishing the risk of electric shock or electrical accident during use. In the particular preferred embodiment which has been shown and described, the rear side of the lamp ribbon has been insulated by the provision of the insulating spots 28 lying over the soldered portions 26 and 27 and the exposed portions of the conductors 13 and 14; but this is not essential to the present invention, and other means might be used for this purpose.

Further, because the two wire terminals 20 and 21 are directly and positively soldered and thus contacted electrically to the conductors 13 and 14, instead of just being squeezed thereagainst by the material of the upper belt layer 11 as was the case in the described prior art, thereby the possibility of poor contact between one of these wire terminals and its conductor is very much diminished. Further, this soldering is easy to perform automatically, and as a result this lamp ribbon accordig to the present invention is cheap to manufacture. There is also no substantial risk of breaking either of the conductors 13 and 14.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiment, or of the drawings, but solely by the scope of the appended claims, which follow.

I claim:

1. A lamp ribbon, comprising:

(a) a thin flexible belt construction, comprising:

(a1) an upper belt layer and a lower belt layer, each generally formed as a strip and made of a flexible electrically insulating material, said upper and lower belt layers being laid against one another, aligned together, and fixed to one another continuously along their respective lengths; and (a2) two conductors, each formed as a strip and made of an electrically conducting material, which are laid between said upper belt layer and said lower belt layer parallel to one another and separated by a certain distance, and which are held by being sandwiched between said upper belt layer and said lower belt layer;

(a3) parts of said lower belt layer at a plurality of places thereon being absent, so as to expose said two conductors for a certain longitudinal distance at each of said plurality of places, at each such place a pair of apertures being formed through said upper belt layer between said two conductors so as to open to said place; and (b) a plurality of lamp units, each comprising:

(b1) a bulb socket which is rigidly attached to said belt construction opposed to a one of said plurality of places where said lower belt layer is absent;

(b2) a pair of terminals which protrude from said bulb socket, each of said terminals passing through one of the pair of apertures formed in said upper belt layer opening to said one of said plurality of places and then being bent over and being soldered to one of said conductors; and (b3) a bulb comprising a pair of terminals and a bulb base into which said bulb is detachably fitted with said terminals of said bulb being bent so as to hold said bulb to said bulb base, said bulb base being slidably fittable into said bulb socket so that each one of said pair of terminals of said bulb is thus electrically connected to one of said terminals of said bulb socket.

2. A lamp ribbon according to claim 1, further comprising a plurality of pieces of insulating material, each being fixed over the exposed parts of said conductors and the exposed parts of said terminals at one of said places and covering them so as to insulate them from the outside.

3. A lamp ribbon according to claim 1, wherein further the exposed surface of said lower belt layer is provided with an adhesive material thereon.

4. A lamp ribbon according to claim 1, wherein said conductors are made of copper and are plated with tin.

5. A lamp ribbon according to claim 1, wherein said apertures formed through said upper belt layer are slits.

* * * * *